US008291698B2

(12) United States Patent
Hikami

(10) Patent No.: US 8,291,698 B2
(45) Date of Patent: Oct. 23, 2012

(54) SOUND INSULATION COVER

(75) Inventor: Takayuki Hikami, Fukuchiyama (JP)

(73) Assignee: Kokusan Parts Industry Co., Ltd., Toyonaka-shi (JP)

( * ) Notice: Subject to any disclaimer, the term of this patent is extended or adjusted under 35 U.S.C. 154(b) by 1115 days.

(21) Appl. No.: 12/213,024

(22) Filed: Jun. 13, 2008

(65) Prior Publication Data

US 2009/0000861 A1 Jan. 1, 2009

(30) Foreign Application Priority Data

Jun. 27, 2007 (JP) ..... 2007-168467

(51) Int. Cl.

| | |
|---|---|
| ***F01N 3/02*** | (2006.01) |
| ***F01N 1/00*** | (2006.01) |
| ***B60S 9/00*** | (2006.01) |
| ***B60S 9/21*** | (2006.01) |

(52) U.S. Cl. ..... 60/323; 60/321; 181/200; 181/204

(58) Field of Classification Search ..... 60/323; 181/200, 204

See application file for complete search history.

(56) References Cited

U.S. PATENT DOCUMENTS

| | | | | |
|---|---|---|---|---|
| 4,836,160 | A * | 6/1989 | Valev | 123/198 E |
| 7,273,128 | B2 * | 9/2007 | Niwa et al. | 181/209 |
| 2005/0140075 | A1 * | 6/2005 | Mishima | 267/140.11 |

FOREIGN PATENT DOCUMENTS

JP 2004-245076 9/2004

* cited by examiner

*Primary Examiner* — Kenneth Bomberg
*Assistant Examiner* — Dapinder Singh
(74) *Attorney, Agent, or Firm* — Edwards Wildman Palmer LLP

(57) ABSTRACT

The sound insulation cover includes: a cover member 21 that is externally mounted on an exhaust manifold and that insulates transmission of noises to the outside; and a fixing means 22 that is combined with an opening 21*a* formed in the cover member 21 in correspondence to a fixing portion 18*a* of the exhaust manifold and that fixes the cover member 21 to the fixing portion 18*a* of the exhaust manifold. The fixing means 22 has: a ring-shaped cover holding plate 23 fixed to the cover member 21 along the edge portion of the opening 21*a* of the cover member 21; and a disk-shaped plate 24 fixed to the fixing portion 18*a* of the exhaust manifold. The inner peripheral portion of the cover holding plate 23 and the outer peripheral portion of the fixing plate 24 are formed into a ring-shaped depressed-projected fit portion 25.

6 Claims, 6 Drawing Sheets

SOUND INSULATION COVER

BACKGROUND OF THE INVENTION

1. Field of the Invention

The present invention relates to a sound insulation cover that can be suitably applied to a noise source such as the exhaust manifold of an engine for an automobile.

2. Description of the Background Art

There have been widely employed sound insulation covers each of which is externally mounted on an exhaust manifold so as to insulate noises from the exhaust manifold to improve quietness in a vehicle and so as to insulate heat from the exhaust manifold to prevent thermal degradation of a harness disposed near the exhaust manifold.

For example, patent document 1 proposes the following technology: a steel plate plated with aluminum and having sound-absorbing and heat-insulating material put thereon in layers is used as a sound insulation cover; and a support jig for supporting the sound insulation cover on an exhaust manifold is composed of a cylindrical part into which a fastening bolt is inserted, a grommet that has a flange extending outside in a radial direction formed on one end of the cylindrical part and that has a small-diameter stepped portion formed on the other end of the cylindrical part, a washer fitted in the small-diameter stepped portion, and a pair of ring-shaped elastic bodies that are fixedly mounted in advance on the one end surface of the washer and on the inside surface of the flange and that are formed by knitting stainless wires, the washer being fixed to the grommet by a fastening portion formed by plastically deforming the small-diameter stepped portion outward in the radial direction to support the sound insulation cover in a state where the sound insulation cover is pinched between the pair of elastic bodies.

Patent document 1: Japanese Unexamined Patent Publication No. 2004-245076

By the way, demands for a reduction in weight in passenger cars are increasing to promote energy savings as much as possible, so there have been employed the sound insulation covers constructed of light-metal plates made of aluminum alloy or the like in place of steel plate. However, vibrations caused when the car is running and vibrations from the engine are transmitted to the sound insulation cover via the exhaust manifold. Thus, when the sound insulation cover is constructed of material having low mechanical strength such as aluminum alloy, even if the support jig described in the patent document 1 is used, there is presented a problem that the relative displacement between the exhaust manifold and the sound insulation cover, caused by the vibrations, cannot be sufficiently absorbed to cause cracks owing to secular changes at the portion where the sound insulation cover is fixed to the exhaust manifold.

SUMMARY OF THE INVENTION

The object of the present invention is to effectively absorb relative displacement caused between a noise source and a sound insulation cover by the noise source being vibrated and to provide a sound insulation cover that is made of light alloy such as aluminum alloy and that can prevent cracks from being caused at a portion where the sound insulation cover is fixed.

A sound insulation cover according to the present invention is a sound insulation cover including: a cover member that is externally mounted on a noise source and that insulates transmission of noises to an outside; and a fixing means that is combined with an opening formed in the cover member in correspondence to a fixing portion of the noise source and that fixes the cover member to the fixing portion of the noise source. The fixing means has: a ring-shaped cover holding plate fixed to the cover member along an edge portion of the opening of the cover member; and a disk-shaped fixing plate fixed to the fixing portion of the noise source, and an inner peripheral portion of the cover holding plate and an outer peripheral portion of the fixing plate are formed into a ring-shaped depressed-projected fit portion in which a projected portion is fitted in a depressed portion so as to freely slide in a direction of inside of a plane, and the cover holding plate and the fixing plate are connected to each other via this depressed-projected fit portion.

In this sound insulation cover, the cover member that is externally mounted on the noise source can effectively insulate transmission of noises and heat from the noise source to the outside. Further, the cover member is fixed to the fixing portion of the noise source via a fixing means made of the cover holding plate and the fixing plate fitted in a depressed-projected manner so as to freely slide in the direction of inside of the plane via the depressed-projected fit portion. Thus, even when the noise source is vibrated, relative displacement between the noise source and the cover member can be effectively absorbed by the cover member sliding in the direction of inside of the plane at the depressed-projected fit portion. For this reason, when this sound insulation cover is employed as a sound insulation cover of the exhaust manifold of an engine for an automobile, noises from the exhaust manifold can be insulated to improve quietness in the vehicle compartment and heat from the exhaust manifold can be insulated to prevent a harness and an electronic unit near the exhaust manifold from being failed due to thermal degradation and heat. In addition, vibrations when the vehicle is running and vibrations from the engine can be effectively absorbed by the cover member sliding at the depressed-projected fit portion and hence the relative displacement between the cover member and the exhaust manifold can be absorbed. Thus, by constructing the cover member of light alloy such as aluminum alloy, the weight of the automobile can be reduced and at the same time the application of a forcible force to the cover member can be prevented, which in turn can prevent the occurrence of cracks at the portion where the sound insulation cover is fixed to the noise source.

Here, there is provided a preferable embodiment of the cover holding plate as follows: the cover holding plate is a pair of ring-shaped cover holding plates that are disposed on both of obverse and reverse sides of the cover member and that have first pinching portions pinching the edge portion of the opening, first overlapping portions overlaid on each other inside the opening, and first inclined portions formed between the first pinching portions and the first overlapping portions, respectively; the fixing plate is a pair of disk-shaped fixing plates that are disposed on both of the obverse and reverse sides of the cover member and that have second pinching portions pinching the first overlapping portions of the pair of cover holding plates overlaid on each other so as to freely slide in the direction of inside of the plane, second overlapping portions that are overlaid on each other in the openings formed in central portions of the cover holding plates and that are fixed to the fixing portion of the noise source, and second inclined portions formed between the second pinching portions and the second overlapping portions, respectively; and the depressed-projected fit portion is constructed of the projected portion of the first overlapping portions of the cover holding plates and the depressed portion of the second pinching portions of the fixing plates. When the sound insulation cover is constructed in this manner, the sound insulation cover of a simple construction of two cover holding plates and two fixing plates can be employed as the fixing means. Thus, it is possible to prevent an increase in the manufacture cost of the sound insulation cover and at the same time to effectively absorb the relative displacement between the cover member and the exhaust manifold. In addition, because the cover holding plates and the fixing plates have the inclined portions, respectively, these inclined portions are deformed in the direction of outside of the plane of the fixing means of the noise source, thereby being able to absorb the relative displacement not only in the direction of inside of the plane but also in the direction of outside of the plane between the noise source and the cover member. Thus, it is possible to more effectively absorb the relative displacement between the noise source and the cover member caused by the vibrations.

An embodiment in which ring-shaped intermediate plates interposed respectively between the first overlapping portions of the pair of cover holding plates and the second pinching portions of the pair of fixing plates overlaid on the first overlapping portions so as to freely slide in the direction of inside of the plane is also a preferable embodiment. In this case, also the intermediate plates can absorb the relative displacement in the direction of inside the plane, so that it is possible to more effectively absorb the relative displacement between the noise source and the cover member.

An embodiment in which one of sliding surfaces of the cover holding plate and the fixing plate has a bead that is formed in an arc cross section and that is put into sliding contact with other sliding surface is also a preferable embodiment. In this case, the displacement in the direction of outside of the plane of the fixing portion of the noise source can be absorbed by the deformation in the direction of compression of the bead.

An embodiment including a spring part that biases the cover holding plates so as to make the cover holding plates and the fixing plates concentric with each other is also a preferable embodiment. In this case, the damping action of the spring part can prevent a large impact load from being applied to the portion where the fixing plates are fitted on the cover holding plates. Thus, it is possible to improve the durability of fixing means and to prevent a decrease in the outside appearance of the fixing means caused by the fixing plate and the cover member being arranged eccentrically with each other.

According to the sound insulation cover in accordance with the present invention, it is possible to effectively insulate the transmission of noises and heat from the noise source to the outside by the cover member externally mounted on the noise source. Further, the cover member is fixed to the fixing portion of the noise source via a fixing means composed of the cover holding plates and the fixing plates that are fitted in the depressed-projected manner via the depressed-projected fit portion so as to freely slide in the direction of inside of the plane, so that even when the noise source is vibrated, the relative displacement between the noise source and the cover member can be effectively absorbed by the cover member sliding in the direction of inside of the plane at the depressed-projected fit portions. For this reason, when this sound insulation cover is employed as a sound insulation cover of the exhaust manifold for the automobile engine, it is possible to insulate noises from the exhaust manifold to thereby improve quietness in the vehicle compartment and at the same time it is possible to insulate heat from the exhaust manifold to thereby prevent the harness and the electronic unit near the exhaust manifold from being failed owing to thermal degradation and heat. In addition, vibrations when the vehicle is running and vibrations from the engine can be effectively absorbed by the cover member sliding at the depressed-projected fit portion and hence the relative displacement between the cover member and the exhaust manifold can be absorbed. Thus, by constructing the cover member of light alloy such as aluminum alloy, the weight of the automobile can be reduced and at the same time the application of a forcible force to the cover member can be prevented, which in turn can prevent the occurrence of cracks at the portion where the sound insulation cover is fixed to the noise source.

DESCRIPTION OF THE PREFERRED EMBODIMENTS

Hereinafter, embodiments of the present invention will be described with reference to the drawings.

Figure 1:
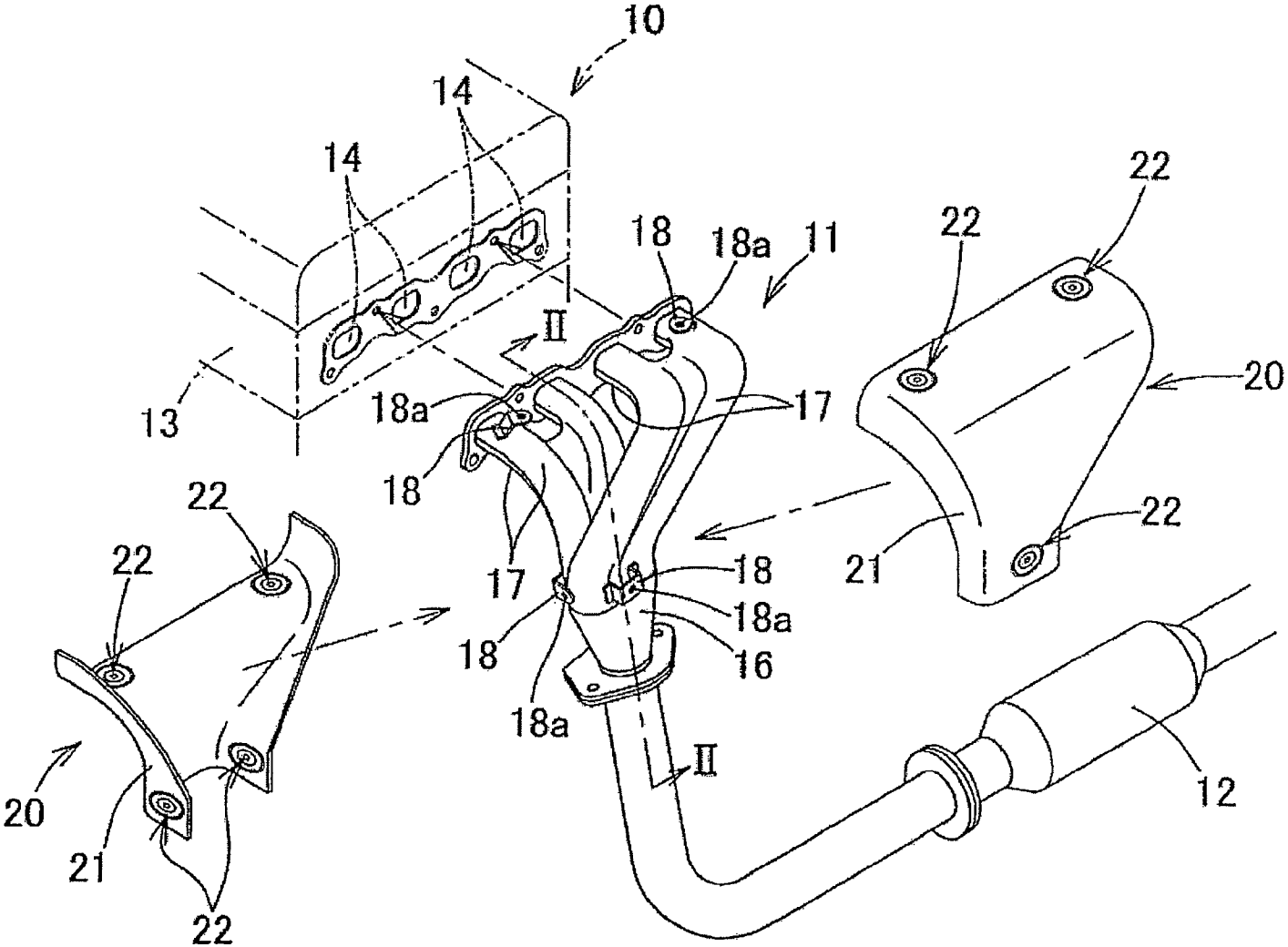
FIG. 1 is a perspective view of the main portion of the exhaust structure of an engine.
Figure 2:
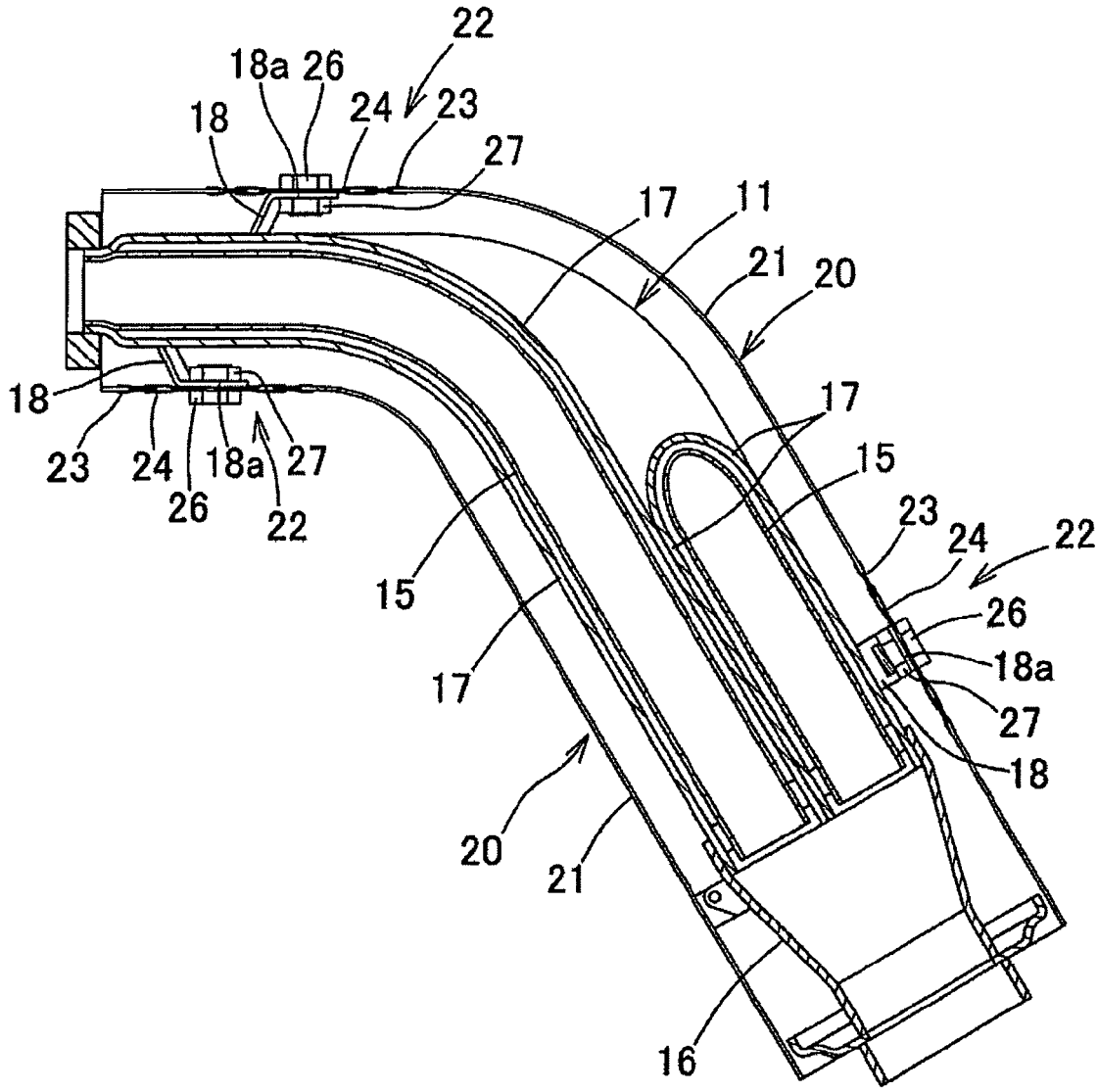
FIG. 2 is a sectional view taken on a line II-II in FIG. 1 in a state where cover members are combined.
Figure 3:
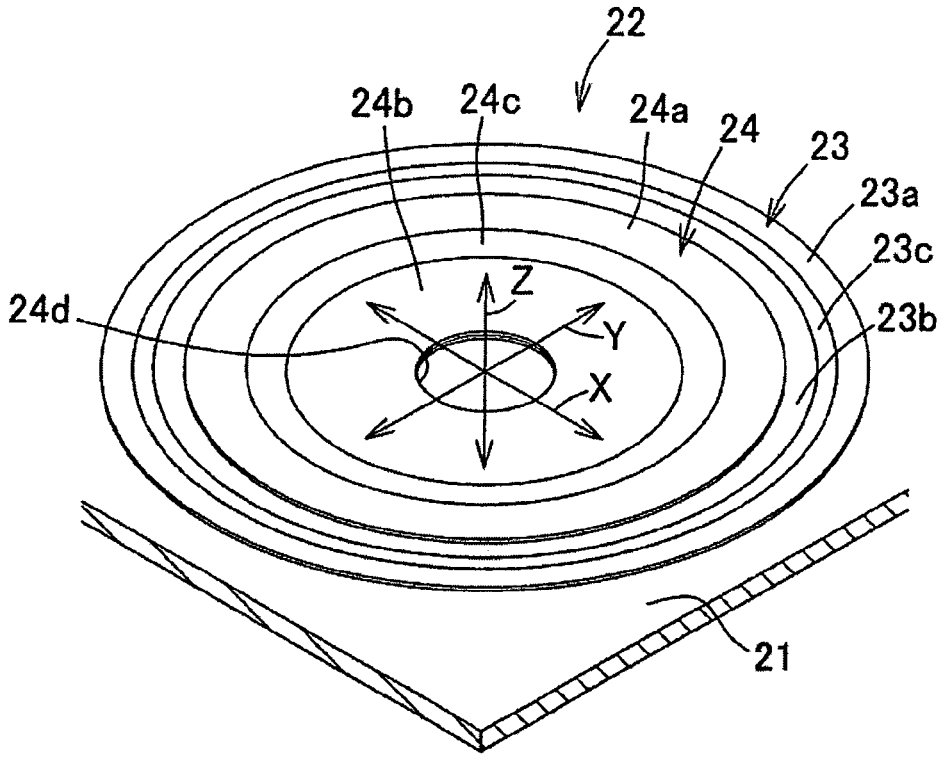
FIG. 3 is a perspective view of a fixing means.
Figure 4:
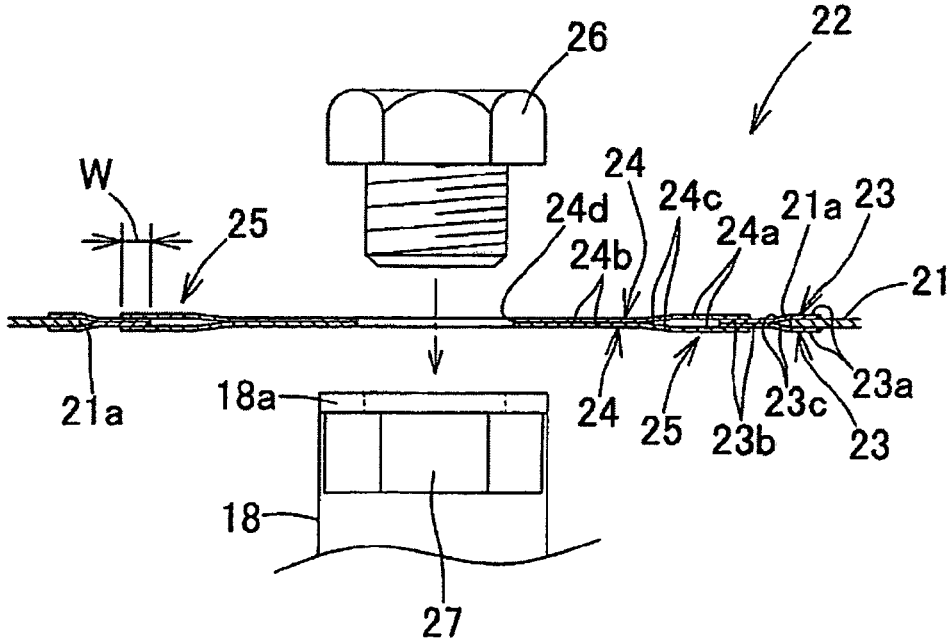
FIG. 4 is a longitudinal sectional view of the fixing means.
Figure 5:
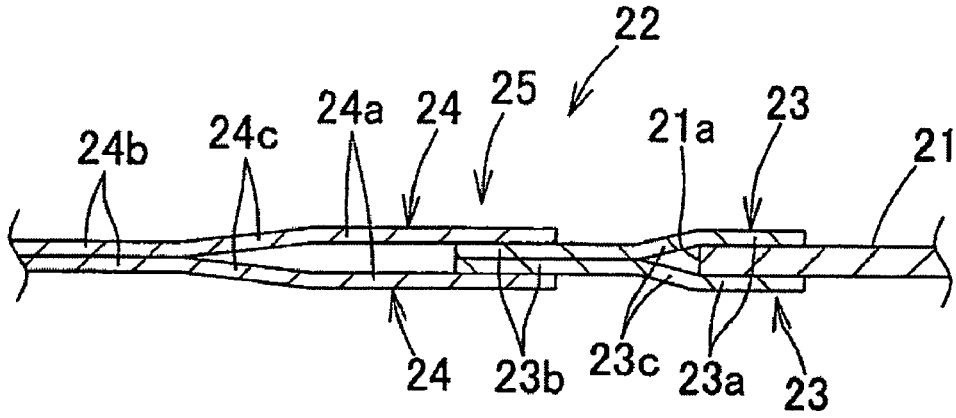
FIG. 5 is a longitudinal sectional view near a depressed-projected fit portion of the fixing means.

As shown in FIG. 1 and FIG. 2, an engine 10 is an in-line 4-cylinder engine for an automobile. An exhaust manifold 11, a catalyst converter 12, and a muffler (not shown) are disposed in this order from an upstream side in the middle of an exhaust passage from this engine 10. Exhaust gas from the engine 10 is collected by the exhaust manifold 11 and is cleaned by the catalyst converter 12 and then has its sound muffled by the muffler and is discharged to the outside.

The exhaust manifold 11 has a well-known construction including four branched pipes 15 connected to four exhaust ports 14 formed in a cylinder head 13, a collection pipe 16 for collecting the downstream ends of these four branched pipes 15, and outer members 17 each covering a pair of neighboring branched pipes 15. However, a well-known construction other than this construction can be used for the exhaust manifold 11.

Sound insulation covers 20 are mounted on both of the upper and lower sides of the exhaust manifold 11 so as to surround the exhaust manifold 11. These sound insulation covers 20 can insulate noises from the exhaust manifold 11 to improve quietness in a vehicle compartment and can insulate heat from the exhaust manifold 11 to prevent a harness and an electronic unit near the exhaust manifold 11 from being failed owing to thermal degradation and heat. However, the sound insulation covers 20 are mounted on both of the upper and lower sides of the exhaust manifold 11 in this embodiment, but the sound insulation cover 20 may be mounted only on the upper side of the exhaust manifold 11 and the sound cover 20 on the lower side may be omitted.

Each of the sound insulation covers 20, as shown in FIG. 1 to FIG. 5, has a cover member 21 that is externally mounted on the exhaust manifold 11 and that insulates the transmission of noises and heat to the outside and fixing means 22 each of which is combined with each of openings 21*a*, which are formed in the cover member 21 in correspondence to the fixing portions 18*a* of bracket members 18 fixed to the exhaust manifold 11, and which fixes the cover member 21 to the fixing portions 18*a* of the exhaust manifold 11.

The cover member 21 is made of a steel plate plated with aluminum, a stainless steel plate, or a metal plate such as a light-alloy plate of aluminum alloy or the like and is formed in a cubic shape along the exhaust manifold 11 by press forming. In particular, in the present invention, the fixing means 22 can effectively absorb relative displacement between the cover members 21 and the exhaust manifold 11, caused by vibrations from the road when the vehicle is running and vibrations from the engine, to be able to prevent the occurrence of cracks. Thus, the sound insulation covers 20 can be constructed of aluminum alloy capable of reducing the weight of the vehicle as much as possible.

However, as the cover member 21 can be also employed a cover member made of two panels of an inner panel and an outer panel that are overlaid on each other in layers and that have their outer peripheral portions fastened by winding, thereby being bonded to each other, or have their outer peripheral portions bonded at middle points by spot welding thereby being bonded to each other. Further, a cover member having sound absorbing material made of ceramic fiber, glass fiber, silica fiber, mineral fiber (rock wool), or the like put in layers between two panels of the inner panel and the outer panel can be also employed as the cover member 21.

Next, describing the fixing means 22 for fixing the cover member 21 to the exhaust manifold 11, as shown in FIG. 2 to FIG. 5, each of the fixing means 22 has: ring-shaped cover holding plates 23 fixed to the cover member 21 along the edge portion of each of the openings 21*a* of the cover member 21; and disk-shaped fixing plates 24 fixed to each of the fixing portions 18*a* of the exhaust manifold 11. And the inner peripheral portions of the cover holding plates 23 and the outer peripheral portions of the fixing plates 24 are formed into a ring-shaped depressed-projected fit portion 25 in which a projected portion is fitted in a depressed portion so as to freely slide in the direction of inside of a plane including an X direction and a Y direction shown in FIG. 3. The cover holding plates 23 are connected to the fixing plates 24 via this depressed-projected fit portion 25.

A pair of cover holding plate 23 and fixing plate 24 are mounted on each of the obverse and reverse sides of the cover member 21 and are made of a stainless steel plate or an iron-based steel plate having excellent abrasion resistance. The thicknesses of the cover holding plate 23 and the fixing plate 24 can be set to arbitrary values but are desirably set to values of 0.1 mm or more to 3 mm or less for weight reduction and sufficient rigidity. The outside diameter of the cover holding plate 23 can be set to an arbitrary value but is set to a value of, for example, 15 mm or more to 50 mm or less so as to be combined with the flat portion of the sound insulation cover 20 formed in a cubic shape by pressing.

The cover holding plates 23 have: first pinching portions 23*a* for pinching the edge of the opening 21*a*; first overlapping portions 23*b* overlaid each other inside the opening 21*a*; and first inclined portions 23*c* formed between the first pinching portions 23*a* and the first overlapping portions 23*b*, respectively.

The fixing plates 24 have: second pinching portions 24*a* for pinching the first overlapping portions 23*b* of the pair of overlaid cover holding plates 23 so as to freely slide in the direction of inside of the plane; second overlapping portions 24*b* overlaid each other inside the openings 21*a* formed in the centers of the cover holding plates 23 and fixed to the fixing portion 18*a* of the noise source; second inclined portions 24*c* formed between the second pinching portions 24*a* and the second overlapping portions 24*b*; and bolt passing holes 24*d* formed in the second overlapping portions 24*b*, respectively.

The depressed-projected fit portion 25 is formed of a depressed portion formed of the second pinching portions 24*a* of the pair of fixing plates 24 and a projected portion formed of the first overlapping portions 23*b* of the pair of cover holding plates 23. In an initial position in which the fixing plates 24 and the cover holding plates 23 are arranged concentrically with each other, the first overlapping portions 23*b* and the second pinching portions 24*a* are made to overlap each other by a width W in the radial direction, and the cover holding plates 23 and the fixing plates 24 are fitted on each other in a depressed-projected manner within a range less than the width W by the depressed-projected fit portion 25 so as to freely slide in the direction of inside of the plane including the X direction and the Y direction in FIG. 3.

When the fixing means 22 is combined with the cover member 21, the pair of cover holding plates 23 are fixed to the cover member 21 by spot welding or the like in a state where the pair of cover holding plates 23 are temporarily put onto the cover member 21 by the use of an adhesive or a magnet, and then the pair of fixing plates 24 are arranged on both of obverse and reverse sides of the cover holding plates 23, and then second overlapping portions 24*b* of the fixing plates 24 are bonded to each other by spot welding or the like, whereby the fixing means 22 is combined with the cover member 21. After the sound insulation covers 20 are combined in this manner, the fixing plates 24 are overlaid on the fixing portions 18*a* of the bracket members 18 fixed to the exhaust manifold 11. Then, bolts 26 are passed through the bolt passing holes 24*d* of the fixing plates 24 and the fixing portions 18*a*, and then the fixing plates 24 are fixed to the fixing portions 18*a* of the bracket members 18 with the bolts 26 and the nuts 27, whereby the sound insulation covers 20 are combined with the exhaust manifold 11. However, a fixing method other than the method using the bolt 26 and the nut 27 can be also employed as the method of fixing the fixing plates 24 to the fixing portions 18*a*.

The sound insulation covers 20 can effectively insulate the transmission of noises and heat from the exhaust manifold 11 to the outside by the cover members 21 externally mounted on the exhaust manifold 11. Further, the cover members 21 are fixed to the exhaust manifold 11 via the fixing means 22 constructed of the cover holding plates 23 and the fixing plates 24, which are freely sliding to each other in the direction of inside of the plane via the depressed-projected fit portion 25, and the cover holding plates 23 and the fixing plates 24 are elastically deformed in the direction of thickness at the inclined portions 23*c*, 24*c*. Thus, even when the exhaust manifold 11 and the cover members 21 are vibrated by vibrations from the engine and vibrations from the road when the vehicle is running to cause relative displacement between the exhaust manifold 11 and the cover members 21, the relative displacement can be effectively absorbed by the sliding movement in the inside direction of the plane at the depressed-projected fit portion 25 and by deformation of the cover holding plates 23 and the fixing plates 24 in the outside direction (Z direction in FIG. 3) of the plane due to the elastic deformation of the inclined portions 23*c*, 24*c*. For this reason, the sound insulation covers 20 can insulate noises from the exhaust manifold 11 to improve quietness in the vehicle compartment and can insulate heat from the exhaust manifold 11 to prevent the harness and the electronic unit near the exhaust manifold 11 from being failed owing to thermal degradation and heat. Further, the vibrations from the road when the vehicle is running and the vibrations from the engine 10 can be effectively absorbed by the cover member sliding at the depressed-projected fit portion 25 and by the cover member being elastically deformed in the inclined portions 23*c*, 24*c*, whereby the relative displacement between the cover member 21 and the exhaust manifold 11 can be absorbed. Thus, by constructing the cover members 21 of light alloy such as aluminum alloy, it is possible to reduce the weight of the automobile and to prevent a forcible force from being applied to the cover members 21 and hence to prevent cracks from being caused at the portions where the sound insulation covers 20 are mounted on the exhaust manifold 11.

Next, other embodiments will be described in which the fixing means 22 are partially changed in the construction. Here, the same parts as those in the above-mentioned embodiment are denoted by the same reference symbols and their detailed descriptions will be omitted.

Figure 6:
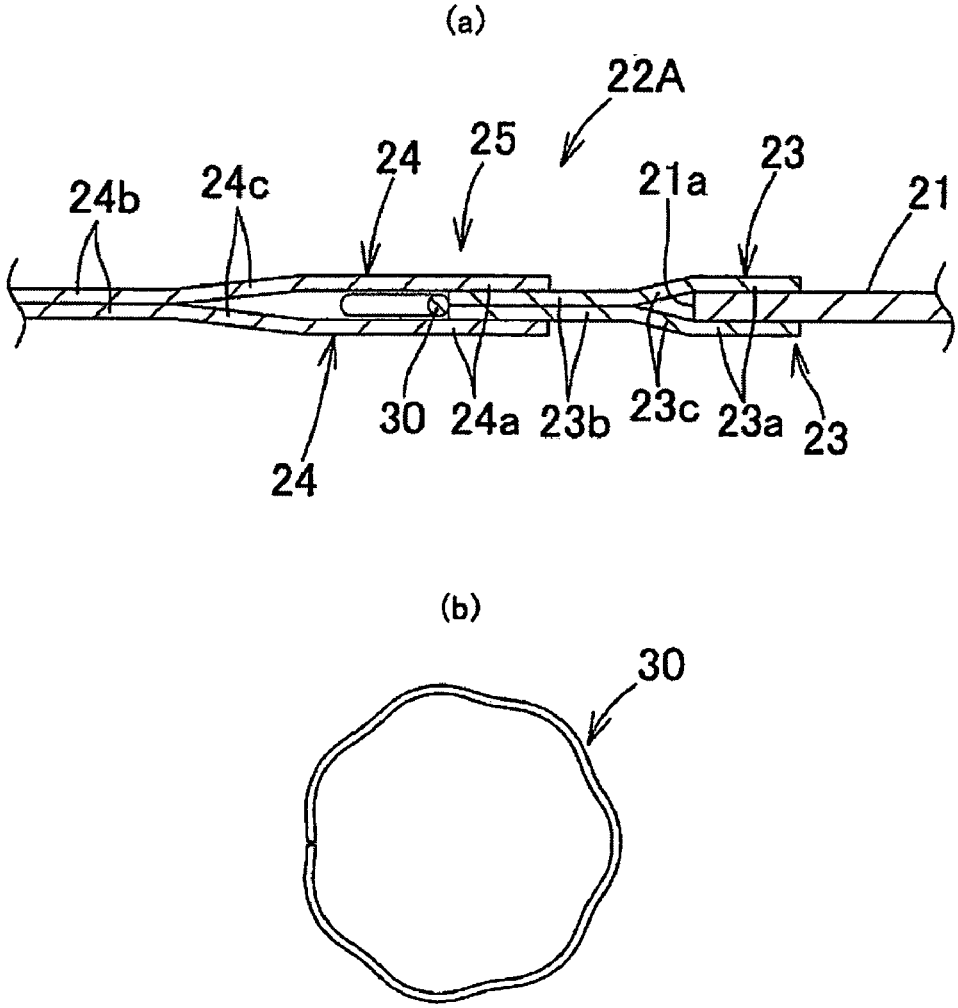
FIG. 6(*a*) is a longitudinal sectional view near a depressed-projected fit portion of the fixing means of another construction, and FIG. 6(*b*) is a plan view of a spring part.
Figure 7:
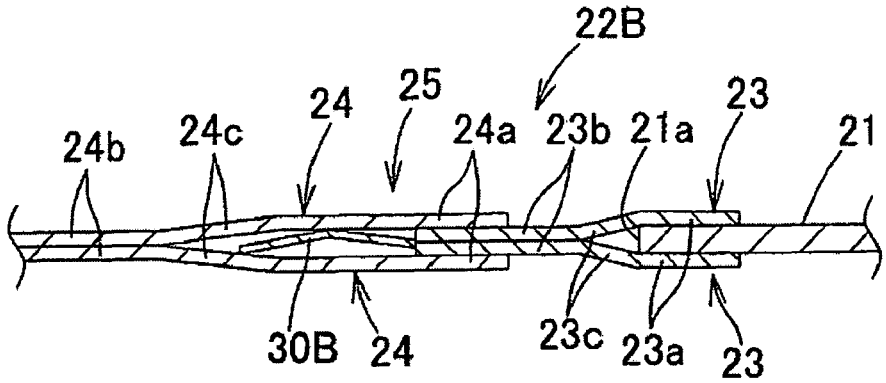
FIG. 7 is a longitudinal sectional view near a depressed-projected fit portion of the fixing means of still another construction.

(1) As shown by a fixing means 22A in FIG. 6, a spring part 30 for biasing the cover holding plates 23 so as to make the cover holding plates 23 and the fixing plates 24 concentric with each other can be interposed between the second pinching portions 24*a*. As shown in FIG. 6(*a*) and FIG. 6(*b*), a ring-shaped spring part 30 having a circular cross section and having amplitude changed in a wavy shape between the first overlapping portions 23*b* and the second inclined portions 24*c* can be used as the spring part 30. Further, in place of the spring part 30, as shown by a fixing means 22B in FIG. 7, a spring part 30B made of a ring-shaped plate spring shaped of a chevron in cross section can be also used.

When there is provided the spring part 30 or 30B like the fixing means 22A or 22B, the cover holding plates 23 and the fixing plates 24 can be biased by the spring part 30 or 30B at the initial position where the cover holding plates 23 and the fixing plates 24 are concentric with each other. Thus, it is possible to prevent vibrations from the exhaust manifold 11 from applying a large impact load to the fitting portion of the fixing plates 24 and the cover holding plates 23 and hence to improve the durability of the fixing means 22A or 22B. Further, it is possible to prevent the outside appearance of the fixing means 22A or 22B from being reduced by the cover holding plates 23 and the fixing plates 24 being arranged eccentrically with each other.

Figure 8:
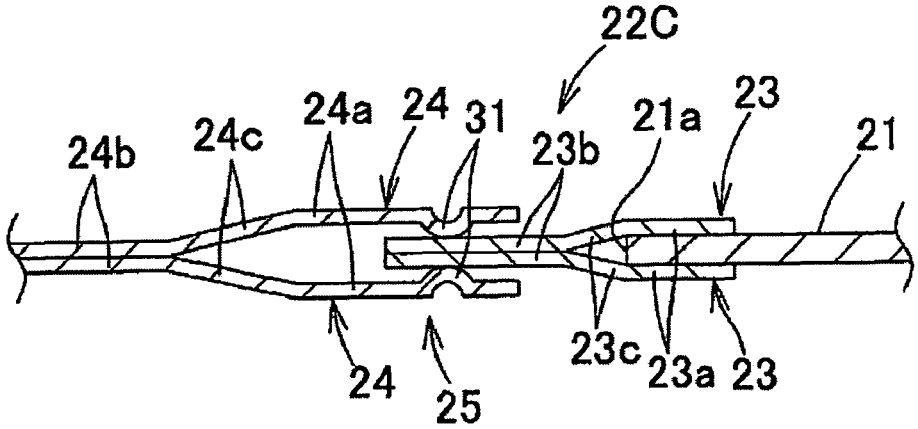
FIG. 8 is a longitudinal sectional view near a depressed-projected fit portion of the fixing means of still another construction.

(2) As shown by a fixing means 22C in FIG. 8, it is also possible to form a ring-shaped bead 31 of an arc cross section in each of the second pinching portions 24*a* of the fixing plates 24 so as to project toward the first overlapping portion 23*b* of the cover holding plate 23 and to press this bead 31 onto the first overlapping portion 23*b* of the cover holding plate 23. With this construction, the elastic deformation of the fixing plates 24 can be further promoted by the elastic deformation of the beads 31 to further effectively absorb the relative displacement in the direction of outside of the plane between the fixing portions 18*a* of the exhaust manifold 11 and the fixing plates 24 of the cover member 21 fixed to the fixing portions 18*a*. However, it is also possible to form a ring-shaped bead of an arc cross section in the first overlapping portion 23*b* of each of the cover holding plates 23, in place of the bead 31, so as to project toward the first pinching portion 23*a* of the fixing plate 24 and to press the bead onto the second pinching portion 24*a* of the fixing plate 24. Further, it is also possible to form the ring-shaped beads on the second pinching portions 24*a* of the fixing plates 24 and the first overlapping portions 23*b* of the cover holding plates 23, respectively, and to abut them against each other. Still further, it is also a preferable embodiment to form one or plural slits in the cover holding plates 23 and the fixing plates 24 and to promote the elastic deformation in the direction of thickness of the cover holding plates 23 and the fixing plates 24.

Figure 9:
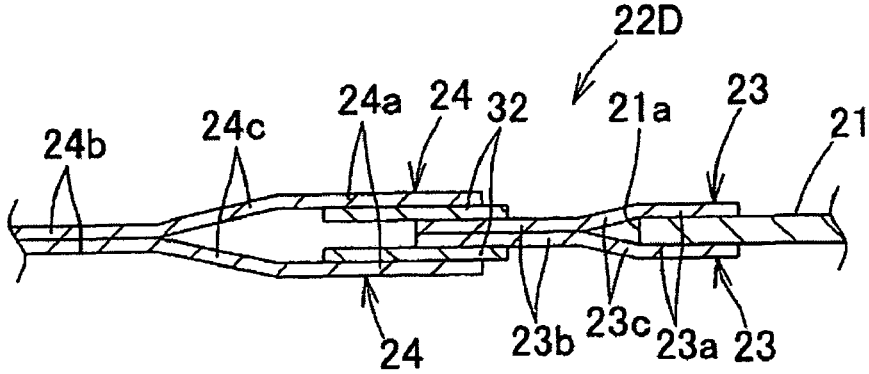
FIG. 9 is a longitudinal sectional view near a depressed-projected fit portion of the fixing means of still another construction.
Figure 10:
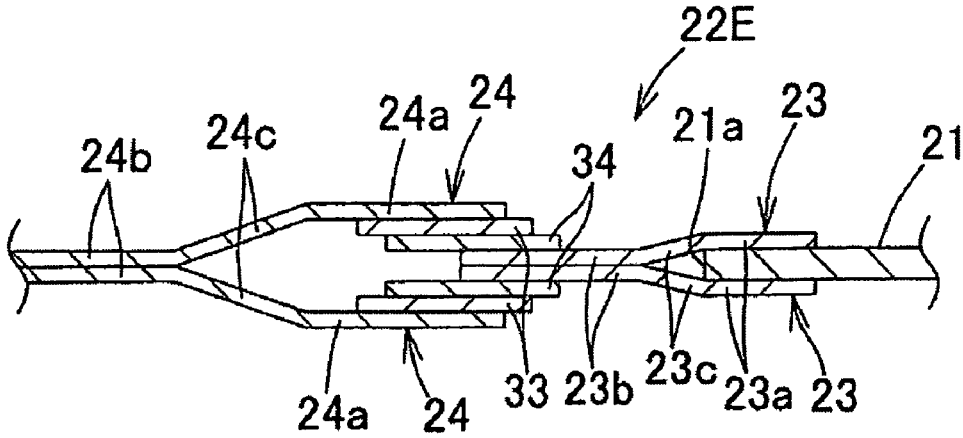
FIG. 10 is a longitudinal sectional view near a depressed-projected fit portion of the fixing means of still another construction.

(3) As shown by a fixing means 22D in FIG. 9, it is also possible to interpose ring-shaped intermediate plates 32 between the first overlapping portions 23*b* of the cover holding plates 23 and the second pinching portions 24*a* of the fixing plates 24, respectively, and to press the first overlapping portions 23*b* onto the intermediate plates 32 so as to freely slide in the direction of inside of the plane, and to press the second pinching portions 24*a* onto the intermediate plates 32 so as to freely slide in the direction of inside of the plane. Further, as shown by a fixing means 22E in FIG. 10, it is also possible to interpose pairs of ring-shaped intermediate plates 33, 34 between the first overlapping portions 23*b* of the cover holding plates 23 and the second pinching portions 24*a* of the fixing plates 24, and to slide the intermediate plates 33, 34 with respect to each other freely in the direction of inside of the plane. In this manner, when the sliding parts are increased in number, the relative displacement between the fixing portion 18*a* of the exhaust manifold 11 and the cover member 21 can be more effectively absorbed. Here, the number of intermediate plates can be increased to three or more but manufacture cost is increased, so the number of intermediate plates is preferably set to one or two. Further, it is possible to form ring-shaped beads on the intermediate plates 32 to 34 and to press these beads onto the second pinching portions 24*a* or the first overlapping portions 23*b*. Alternatively, when there are provided two or more intermediate plates, it is possible to form beads on the neighboring intermediate plates and to press the beads onto each other.

Figure 11:
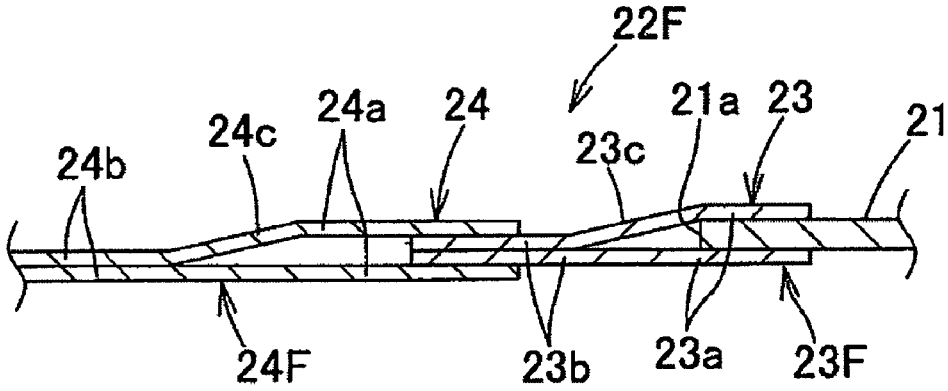
FIG. 11 is a longitudinal sectional view near a depressed-projected fit portion of the fixing means of still another construction.

(4) As shown by a fixing means 22F in FIG. 11, one of the cover holding plates 23 can be also constructed of a flat cover holding plate 23F having the first inclined portion 23*c* omitted therefrom, or one of the fixing plates 24 can be also constructed of a flat fixing plate 24F having the second inclined portion 24*c* omitted therefrom.

While the present invention is applied to the sound insulation covers 20 externally mounted on the exhaust manifold 11 of the in-line 4-cylinder engine in this embodiment, the present invention can be similarly applied to a sound insulation cover externally mounted on a multi-cylinder engine other than a 4-cylinder engine. Further, the sound insulation covers 20 of the present invention are applied to the exhaust manifold 11 as a noise source, but the present invention can be similarly applied also to a noise source other than the exhaust manifold 11. In particular, the present invention can be suitably employed as the sound insulation cover 20 of a noise source causing vibrations.

What is claimed is:

1. A sound insulation cover comprising:

a cover member that is externally mounted on a noise source and that insulates transmission of noises to an outside; and a fixing means that is combined with an opening formed in the cover member in correspondence to a fixing portion of the noise source and that fixes the cover member to the fixing portion of the noise source, wherein the fixing means has: a ring-shaped cover holding plate fixed to the cover member along an edge portion of the opening of the cover member; and a disk-shaped fixing plate fixed to the fixing portion of the noise source, an inner peripheral portion of the cover holding plate and an outer peripheral portion of the fixing plate being formed into a ring-shaped depressed-projected fit portion in which a projected portion is fitted in a depressed portion so as to freely slide in a direction of inside of a plane, the cover holding plate and the fixing plate being connected to each other via this depressed-projected fit portion, wherein one of the sliding surfaces of the cover holding plate and the fixing plate has a bead that is formed in an arc cross section and that is put into sliding contact with the other sliding surface.

2. The sound insulation cover according to claim 1, wherein the cover holding plate is a pair of ring-shaped cover holding plates that are disposed on both of obverse and reverse sides of the cover member and that have first pinching portions pinching the edge portion of the opening, first overlapping portions overlaid on each other inside the opening, and first inclined portions formed between the first pinching portions and the first overlapping portions, respectively, wherein the fixing plate is a pair of disk-shaped plates that are disposed on both of the obverse and reverse sides of the cover member and that have second pinching portions pinching the first overlapping portions of the pair of cover holding plates overlaid on each other so as to freely slide in the direction of inside of the plane, second overlapping portions that are overlaid on each other in the openings formed in central portions of the cover holding plates and that are fixed to the fixing portions of the noise source, and second inclined portions formed between the second pinching portions and the second overlapping portions, respectively, and wherein the depressed-projected fit portion is constructed of the projected portion of the first overlapping portions of the cover holding plates and the depressed portion of the second pinching portions of the fixing plates.

3. The sound insulation cover according to claim 2, further comprising ring-shaped intermediate plates interposed respectively between the first overlapping portions of the pair of cover holding plates and the second pinching portions of the pair of fixing plates overlaid on the first overlapping portions so as to freely slide in the direction of inside of the plane.

4. The sound insulation cover according to claim 1, further comprising a spring part that biases the cover holding plates so as to make the cover holding plates and the fixing plates concentric with each other.

5. The sound insulation cover according to claim 2, further comprising a spring part that biases the cover holding plates so as to make the cover holding plates and the fixing plates concentric with each other.

6. The sound insulation cover according to claim 3, further comprising a spring part that biases the cover holding plates so as to make the cover holding plates and the fixing plates concentric with each other.

* * * * *